United States Patent [19]

Stammler et al.

[11] Patent Number: 4,921,124

[45] Date of Patent: May 1, 1990

[54] PRESSURE COMPENSATING ELEMENT FOR ELECTRONIC DEVICE ENCLOSURE

[75] Inventors: Kurt Stammler, Anderson, S.C.; Lothar Ruttkowski, Ludwigsburg, Fed. Rep. of Germany

[73] Assignee: Robert Bosch GmbH, Stuttgart, Fed. Rep. of Germany

[21] Appl. No.: 350,542

[22] Filed: May 11, 1989

[30] Foreign Application Priority Data

May 20, 1988 [DE] Fed. Rep. of Germany ..... 3817227

[51] Int. Cl.[5] ..... B65D 51/16

[52] U.S. Cl. ..... 220/367

[58] Field of Search ..... 220/367, 368, 369, 370, 220/371, 372, 373, 374, 85 P; 174/12 R

[56] References Cited

U.S. PATENT DOCUMENTS 1,426,501 8/1922 Parizek ..... 220/374
3,064,668 11/1962 Alkire ..... 220/367
3,199,716 8/1965 Price ..... 220/374
3,625,389 12/1971 Bortlow ..... 220/367
4,609,126 9/1986 Janda ..... 220/374

FOREIGN PATENT DOCUMENTS 3707050 9/1988 Fed. Rep. of Germany .

*Primary Examiner*—George E. Lowrance
*Attorney, Agent, or Firm*—Frishauf, Holtz, Goodman & Woodward

[57] ABSTRACT

A pressure equalizing element for an electronic device enclosure, e.g. for a control device under the hood of a vehicle, features a water-tight but air-transmitting region (21) which equalizes pressure between the interior airspace of the enclosure and ambient airspace. The element preferably includes a porous PTFE foil element which is bowed so that water will not pool on it and clog the air pores. Thus, it will be operative, and can be installed, in any desired orientation. The foil is protected against puncture by surrounding support elements of metal and/or plastic and is adapted to be automatically mass-produced and tested prior to installation.

5 Claims, 1 Drawing Sheet

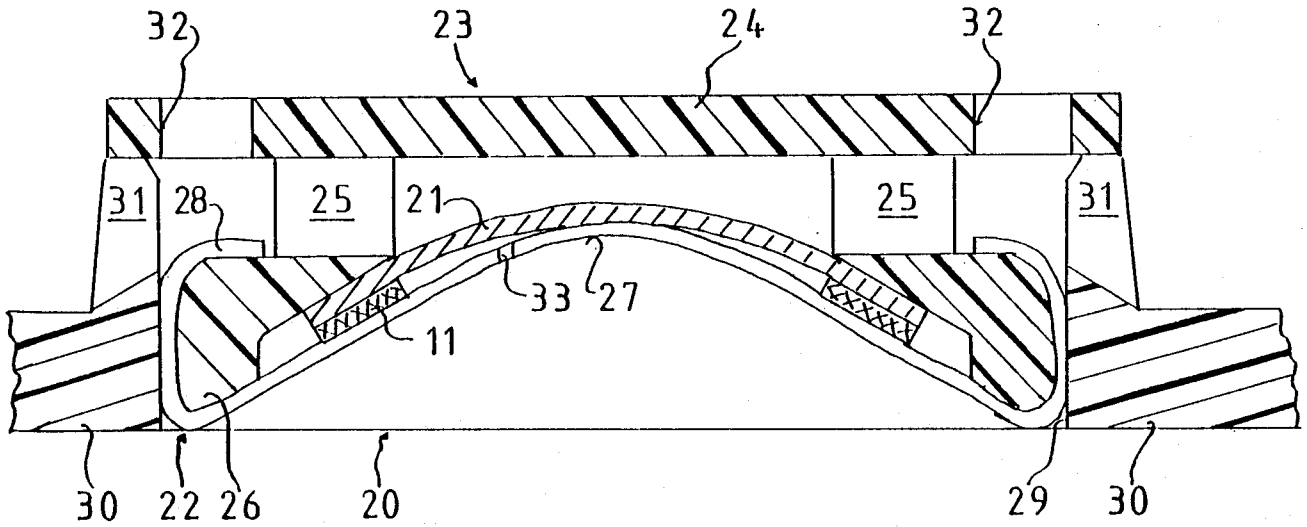
32
31
28
25
25
21
23
24
32
31
33
27
11
26
22
29
30
30
20

PRESSURE COMPENSATING ELEMENT FOR ELECTRONIC DEVICE ENCLOSURE

Cross-reference to related disclosure, assigned to the assignee of the present invention:

German patent disclosure DE-OS 37 07 050, HESS & HOFMEISTER, published Sept. 15, 1988.

The present invention relates generally to enclosures for electronic devices and, more particularly, to such an enclosure with a pressure compensating or equalizing element.

BACKGROUND

Pressure equalizing elements assist in the ventilation of tightly closed housings, particularly of electrical circuit devices, as they are used in motor vehicles. Such elements minimize the seeping of water into the housing interior, but permit compensation of pressure differences, for example arising from temperature changes, between the interior air and the surrounding environment. Pressure equalization is, however, only assured if water reaching the pressure equalization element can immediately run off.

German patent disclosure DE-OS 37 07 050 of March 5, 1987, published Sept. 15, 1988, HESS & HOFMEISTER, discloses using, as a pressure compensating element, a flat membrane of air-transmitting material, for example, a polytetrafluoroethylene (PTFE) foil material. This membrane permits compensation of pressure differences between the two sides of the membrane.

The disadvantage of this pressure equalizing element is that the pressure equalization is not possible if water is standing on the membrane. This means that such an element can only be located in the housing wall of such an electrical device, in order that water reaching the membrane will run off.

THE INVENTION

The pressure equalizing element with the continuous external curvature of the present invention has the advantage that any installation position desired can be selected, without impairing the function of the element. Even if water streams across a housing or electrical enclosure equipped with this inventive pressure compensating element, runoff of the water is assured and trouble-free pressure equalization is possible. Particular advantageous is the simple structure of the pressure equalizing element of the present invention. It features a water-tight but air-transmitting region which is curved in such a manner that water immediately runs off. The inner and outer surfaces of this region communicate respectively with the surrounding air and the interior of the device or housing, so that pressure changes, e.g. resulting from temperature fluctuations, are compensated.

According to a preferred embodiment, a membrane of porous or air-transmissive foil is used which is bowed, at least in the region which serves for pressure equalization, by a support element. The outwardly bowed side of the membrane faces the outside of the device or enclosure, so that any incident water can run off. This assures continuous pressure equalization.

Further features and embodiments include tensioning the foil membrane between two support elements so that together they form a pre-assembled unit for installation in an electronic device enclosure, and providing a circumferential sealing element between membrane and support element. A particularly desirable feature is that the structure permits automatic mass production in great quantities and testing before the element is needed. Furthermore, the dimensions of the element are so small that it can be universally used, even in small electrical devices.

DRAWINGS

The single figure shows a pressure equalization element with a bowed, air-transmissive membrane.

DETAILED DESCRIPTION

Pressure equalization element 20 features an air-transmissive foil 21, which may for example comprise polytetrafluoroethylene (PTFE), sometimes sold under the trademark TEFLON. The foil is sandwiched or clamped between a first support element 22 and a second support element 23. Preferably, a circumferential sealing element 11 is provided between the foil and first support element 22.

Second support element 23 has a substantially flat cover 24, from which depend rods 25. These rods merge into a ring 26 having an essentially L-shaped cross-section. The inner side of ring 26 which faces away from cover 24 is bevelled and serves as a support surface for the bowed foil 21. Second support element 23 preferably comprises plastic.

Foil 21 is pressed by first support element 22 against the bevelled inner surface of ring 26, which is preferably of metal and may, for example, be manufactured by deep-drawing. As the cross-sectional view indicates, first support element 22 is essentially bowl-shaped, with a bottom 27 which bows upward as seen in the Figure, and projects into the space defined by the surrounding rods 25 and ring 26 of second support element 23. Prior to assembly of pressure equalization element 20, the sidewalls 28 of first support element 22 project substantially perpendicularly upward. The inner diameter of the sidewalls is large enough for ring 26 of second support element 23 to be inserted. The height of the sidewalls 28 is selected such that, after insertion of ring 26, the sidewalls can be bent over ring 26, thus gripping its outer or upper surface. The foil 21 tensioned between the two support elements 22 and 23 is bowed by the curved bottom 27 of first support element 22.

The complete pressure equalization element is installed in an opening 29 of wall 30 (of which only a fragment is shown) of an electronic device enclosure. In the illustration of the Figure, the inner side of the device is below housing wall 30 and the outside of the enclosure is above wall 30. From the housing wall 30, there extend posts 31, whose inner or facing surfaces are continuous with the wall of opening 29. Cover 24 of second support element 23 rests the tops of posts 31. The posts 31 and rods 25 are so staggered with respect to each other that foil 21 is not reachable from outside with straight instruments, such as screwdrivers and the like. Cover 24 is formed with apertures or punch-outs 32, but they also are arranged so that foil 21 cannot be reached through them. That is, they are located in the cover rim area, not the more central area between rods 25. Incident water which comes in through apertures 32 and between posts 31 and rods 25 to reach foil 21, can immediately run off, even when the pressure equalization element is oriented horizontally, as shown in the Figure. As soon as the water runs off, foil 21 carries out an equalization of pressure between the interior of the housing of the electronic device and the ambient airspace. For this purpose, a plurality of small holes 33 are provided in bottom 27, in the area surrounded by the preferably circular seal element 11. The diameter of holes 33 is chosen small enough that no instrument capable of puncturing foil 21 can fit through, even when the pressure equalization element is not mounted in a housing wall.

As the Figure makes apparent, the pressure equalization element of the present invention can be automatically made in great quantities and tested for proper air transmissivity. The pre-assembled elements are due to their structure, insensitive to mechanical disturbances and can be readily stored. It is further apparent that the pressure equalization element is relatively flat and can thus be fitted into small device enclosures.

Various changes and modifications are possible within the scope of the inventive concept.

We claim:

1. Pressure equalizing element, for an electronic device enclosure, having a water-tight but air-transmissive region (21) which communicates with both an interior airspace of said enclosure and ambient airspace, wherein, in accordance with the invention, said region (21) has a bowed shape which facilitates runoff of any water contained in said ambient air.

2. Pressure equalizing element according to claim 1, wherein said bowed region is part of a water-tight but air-transmissive, tensioned foil which is bowed, at least in an air-equalizing region, by a first support element (22).

3. Pressure equalizing element according to claim 2, wherein said foil is tensioned between said first support element (22) and a second support element (23), said foil and said support elements forming a pre-assembled unit adapted for insertion in an opening (29) in a wall (30) of an electronic device enclosure.

4. Pressure equalizing element according to claim 2, further comprising a sealing element (11) placed between said foil (21) and at least one of said support elements (22, 23).

5. Pressure equalizing element according to claim 3, further comprising a sealing element (11) placed between said foil (21) and at least one of said support elements (22, 23).

* * * * *